US011016429B2

(12) United States Patent
Ando et al.

(10) Patent No.: US 11,016,429 B2
(45) Date of Patent: May 25, 2021

(54) IMAGE FORMING DEVICE THAT SELECTS FEEDING MODE ACCORDING TO TYPE OF INSERTION SHEET

(71) Applicant: CANON KABUSHIKI KAISHA, Tokyo (JP)

(72) Inventors: Yutaka Ando, Toride (JP); Toshiyuki Miyake, Nagareyama (JP); Akihiro Arai, Toride (JP); Riki Fukuhara, Funabashi (JP); Yuichiro Oda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 15/985,955

(22) Filed: May 22, 2018

(65) Prior Publication Data

US 2018/0348689 A1 Dec. 6, 2018

(30) Foreign Application Priority Data

Jun. 1, 2017 (JP) ..... JP2017-109318

(51) Int. Cl.

*B65H 33/04* (2006.01)
*G03G 15/00* (2006.01)
*B42C 1/12* (2006.01)

(52) U.S. Cl.

CPC ..... *G03G 15/655* (2013.01); *B42C 1/12* (2013.01); *G03G 15/502* (2013.01); *G03G 15/6508* (2013.01); *B65H 2511/30* (2013.01); *B65H 2511/414* (2013.01); *B65H 2511/51* (2013.01); *B65H 2511/515* (2013.01)

(58) Field of Classification Search

CPC ..... G03G 15/655; G03G 15/6508; G03G 15/502; B42C 1/12; B65H 33/04

See application file for complete search history.

(56) References Cited

U.S. PATENT DOCUMENTS 4,503,960 A * 3/1985 Koeleman ..... B65H 7/02 192/127
4,815,725 A 3/1989 Kanaya
5,237,382 A * 8/1993 Matsumura ..... G03G 15/655 271/298

(Continued)

FOREIGN PATENT DOCUMENTS

JP 61-81347 A 4/1986
JP 61-277529 A 12/1986

(Continued)

OTHER PUBLICATIONS

Office Action dated Apr. 2, 2021, in Japanese Patent Application No. 2017-109318.

*Primary Examiner* — Patrick H Mackey
(74) *Attorney, Agent, or Firm* — Venable LLP

(57) ABSTRACT

A control unit of an image forming device determines a remaining amount threshold value and selects a first mode or a second mode. In the first mode, a sheet feeding unit of the image forming device starts feeding a sheet based on presence/absence of an insertion sheet that is to be inserted by an inserter device immediately prior to a sheet fed from the sheet feeding unit. In the second mode, the sheet feeding unit starts feeding a sheet regardless of presence/absence of an insertion sheet that is to be inserted by the inserter device immediately prior to a sheet fed from the sheet feeding unit.

6 Claims, 14 Drawing Sheets

(56) References Cited

U.S. PATENT DOCUMENTS

| | | | | |
|---|---|---|---|---|
| 6,442,368 | B1 * | 8/2002 | Ohtsuka | G03G 15/655 399/382 |
| 6,669,384 | B2 | 12/2003 | Furuya et al. | |
| 7,878,496 | B2 | 2/2011 | Fujii et al. | |
| 7,887,045 | B2 * | 2/2011 | Baena, Jr. | B65H 1/14 271/152 |
| 7,913,995 | B2 * | 3/2011 | Clark | B65H 1/14 271/126 |
| 8,038,139 | B2 | 10/2011 | Nishimura et al. | |
| 8,157,255 | B2 | 4/2012 | Nishimura et al. | |
| 8,406,681 | B2 | 3/2013 | Miyake | |
| 8,469,349 | B2 * | 6/2013 | Maeda | G03G 15/655 270/58.31 |
| 8,717,583 | B2 * | 5/2014 | Igarashi | G03G 15/655 271/3.14 |
| 8,849,177 | B2 * | 9/2014 | Oba | G03G 15/655 399/382 |
| 9,663,310 | B2 | 5/2017 | Hirajima | |
| 9,783,383 | B2 * | 10/2017 | Kaneda | B65H 3/44 |
| 2003/0015836 | A1 * | 1/2003 | Westcott | B65H 1/18 271/152 |
| 2010/0270733 | A1 * | 10/2010 | Freeston | B65H 1/14 271/126 |
| 2010/0284721 | A1 * | 11/2010 | Nakamura | G03G 15/6541 399/407 |

FOREIGN PATENT DOCUMENTS

| | | | | |
|---|---|---|---|---|
| JP | 2001-335187 | A | | 12/2001 |
| JP | 2003-104576 | A | | 4/2003 |
| JP | 2003-221160 | A | | 8/2003 |
| JP | 2003221160 | A | * | 8/2003 |
| JP | 2010-281879 | A | | 12/2010 |
| JP | 2016-222447 | A | | 12/2016 |

* cited by examiner

FIG. 11A

| GRAMMAGE [gsm] | ~79 | 80~105 | 106~209 | 210~300 | 301~325 | 326~ |
|---|---|---|---|---|---|---|
| THRESHOLD VALUE [%] | 15 | 20 | 25 | 30 | 35 | 40 |

FIG. 11B

| SHEET TYPE | THIN PAPER | PLAIN PAPER | THICK PAPER 1 | THICK PAPER 2 | THICK PAPER 3 | THICK PAPER 4 | OHP |
|---|---|---|---|---|---|---|---|
| GRAMMAGE [gsm] | ~79 | 80~105 | 106~209 | 210~300 | 301~325 | 326~ | 151~180 |
| THRESHOLD VALUE [%] | 15 | 20 | 25 | 30 | 35 | 40 | 25 |

IMAGE FORMING DEVICE THAT SELECTS FEEDING MODE ACCORDING TO TYPE OF INSERTION SHEET

BACKGROUND OF THE INVENTION

Field of the Invention

The present invention relates to an image forming device that selects a feeding mode according to the type of an insertion sheet.

DESCRIPTION OF THE RELATED ART

In some cases, an inserter for inserting an insertion sheet into a plurality of sheets on which images have been formed is connected to an image forming device. An insertion sheet is a sheet that is inserted into a sheet bundle every predetermined number of sheets. If there is no insertion sheet held by the inserter, the sheet bundle becomes incomplete. For example, a sheet bundle that should include 100 sheets becomes a sheet bundle that includes 99 sheets. Particularly, with a sheet bundle for which stapling is performed, it is extremely difficult to manually insert a missing insertion sheet, and thus this sheet bundle will be discarded.

Japanese Patent Laid-Open No. 2003-221160 proposes a technique for, when the remaining amount of insertion sheets stacked on an inserter tray decreases, switching a transfer sheet feeding mode from a snap decision (non-confirmation) mode to a confirmation mode. The snap decision (non-confirmation) mode is a feeding mode that is adopted when the remaining amount of insertion sheets is large, and is a mode in which, when a certain transfer sheet is to be fed, that transfer sheet is fed without confirming the existence of the insertion sheet that is to be inserted immediately prior to that transfer sheet. Because the existence of an insertion sheet is omitted, productivity is improved in the snap decision (non-confirmation) mode. The confirmation mode is a feeding mode that is adopted when the remaining amount of insertion sheets is small, and is a feeding mode in which the feeding of a transfer sheet is performed after confirming the existence of an insertion sheet that is to be inserted immediately prior to that transfer sheet.

According to Japanese Patent Laid-Open No. 2003-221160, when a filler, which rises each time an insertion sheet is fed, blocks a near-end sensor (light transmission sensor), it is determined that the remaining amount of insertion sheets is small. However, in Japanese Patent Laid-Open No. 2003-221160, the thickness of an insertion sheet is not considered. The remaining amount of insertion sheets at the time when the filler blocks the near-end sensor is inversely proportional to the thickness of the insertion sheet. That is, with thin paper, although the remaining amount is large, the confirmation mode is applied. This causes a decrease in productivity. On the other hand, with thick paper, even if the remaining amount is small, the snap decision (non-confirmation) mode is applied.

SUMMARY OF THE INVENTION

In the present invention, a feeding mode is appropriately selected in accordance with the type of an insertion sheet. The present invention may provide an image forming system comprising the following structural elements. An image forming device forms an image on a sheet. An inserter device inserts an insertion sheet between a plurality of sheets conveyed from the image forming device. A stacker device stacks the sheet on which the image was formed and the insertion sheet inserted by the inserter device. The image forming device may include the following structural elements. A sheet feeding unit feeds a sheet. An image forming unit forms an image on the sheet fed by the sheet feeding unit. The inserter device may include an insertion sheet feeding unit that feeds an insertion sheet; and an obtainment unit that obtains a remaining amount of insertion sheets stacked on an insertion sheet stacking section provided at the insertion sheet feeding unit. The image forming device further includes a control unit that controls the image forming device and the inserter device. The control unit includes a determination unit that determines a remaining amount threshold value that is in accordance with a type of the insertion sheet, and a selection unit that, in a case where the remaining amount of insertion sheets obtained by the obtainment unit is less than or equal to the remaining amount threshold value, selects a first mode as a feeding mode of the sheet feeding unit, and, in a case where the remaining amount of insertion sheets obtained by the obtainment unit is larger than the remaining amount threshold value, selects a second mode as the feeding mode of the sheet feeding unit. The first mode is a mode in which the sheet feeding unit starts feeding a sheet based on presence/absence of an insertion sheet that is to be inserted by the inserter device immediately prior to a sheet fed from the sheet feeding unit. The second mode is a mode in which the sheet feeding unit starts feeding a sheet regardless of presence/absence of an insertion sheet that is to be inserted by the inserter device immediately prior to a sheet fed from the sheet feeding unit.

Further features of the present invention will become apparent from the following description of exemplary embodiments (with reference to the attached drawings).

BRIEF DESCRIPTION OF THE DRAWINGS

FIGS. 11A and 11B are diagrams showing a conversion table.

DESCRIPTION OF THE EMBODIMENTS

Overall Configuration

Figure 1:
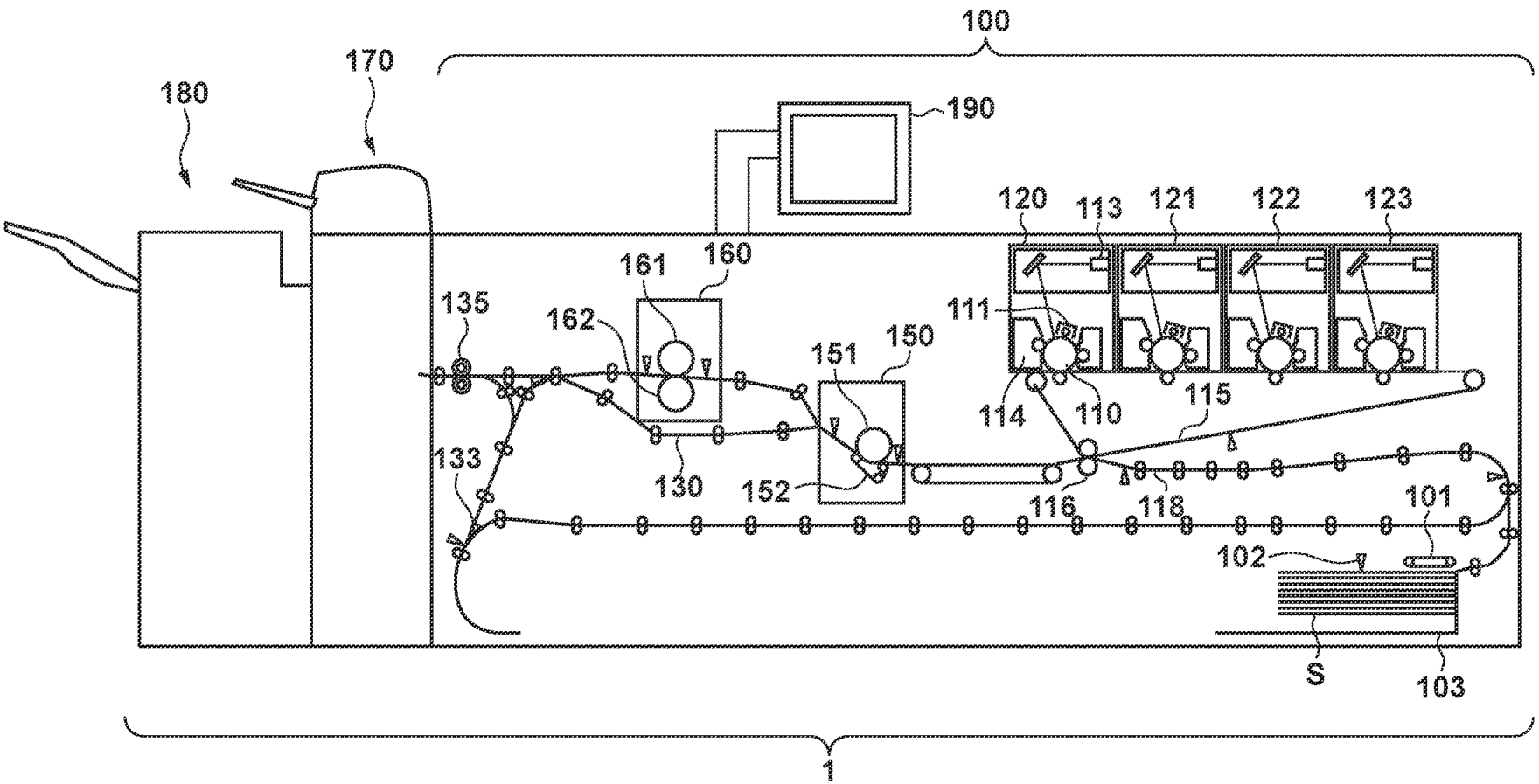
FIG. 1 is a schematic cross-sectional view showing an image forming system.

As shown in FIG. 1, an image forming system 1 includes an image forming device 100, a finisher 180, and an inserter 170. Note that the inserter 170 may be built into the image forming device 100. For example, a manual feed tray or the like provided at the image forming device 100 may be employed as the inserter 170.

Image Forming Device

The image forming device 100 is an electrophotographic image forming device. Note that another image forming method, such as an inkjet method or the like, may be employed. A pickup roller 101 feeds sheets S contained in a sheet storage 103 to a conveyance path. A sheet sensor 102 is a sensor that detects whether or not the sheet S exists in the sheet storage 103. A registration roller 118 conveys the sheet S and sends it to a secondary transfer unit. The secondary transfer unit includes an intermediate transfer member 115 and a secondary transfer roller 116.

In the image forming device 100, four stations 120, 121, 122, and 123 corresponding to Y, M, C, and K are provided. YMCK represents toner colors and is an abbreviation for yellow, magenta, cyan, and black. The stations 120, 121, 122, and 123 are image forming units that transfer toner to a sheet to form an image. The stations 120, 121, 122, and 123 are configured by substantially the same parts. A photosensitive drum 110 is one type of an image carrier. A primary charger device 111 uniformly charges the surface of the photosensitive drum 110. An exposure device 113 emits laser light to the photosensitive drum 110 and forms an electrostatic latent image. A developing device 114 uses toner to develop an electrostatic latent image and form a toner image. A primary transfer device 117 primary-transfers the toner image carried on the photosensitive drum 110 onto the intermediate transfer member 115. The intermediate transfer member 115, while rotating, conveys the toner image to the secondary transfer unit. The secondary transfer roller 116 provided at the secondary transfer unit transfers the toner image onto the sheet S.

A fixing processing mechanism includes a first fixing device 150 and a second fixing device 160 that heat and press the toner image, which has been transferred onto the sheet S, to fix the toner image onto the sheet. The first fixing device 150 includes a fixing roller 151 for heating the sheet S and a pressure belt 152 for pressing the sheet S against the fixing roller 151. The fixing roller 151 is a hollow roller that has a heater inside. The second fixing device 160 is disposed downstream in a conveyance direction of the sheet S relative to the first fixing device 150. The second fixing device 160 adds gloss (sheen) to the toner image on the sheet S that was fixed by the first fixing device 150, and, with respect to a sheet S that has a large grammage and requires a large amount of heat like thick paper, compensates for the amount of heat that is insufficient by being provided only from the first fixing device 150. The second fixing device 160 includes a fixing roller 161 and a pressure roller 162. The fixing roller 161 and the pressure roller 162 are each a hollow roller that has a heater inside. Depending on the type of the sheet S, it is not necessary to pass the sheet S through the second fixing device 160. In this case, in order to reduce energy consumption, the sheet S passes through a conveyance path 130 instead of passing through the second fixing device 160. A discharge roller 135 discharges the sheet S to the outside of the image forming device 100. In this example, the sheet S is discharged to the inserter 170.

The inserter 170 is connected to the image forming device 100, and is an inserter device that inserts an insertion sheet before or after the sheet S. The inserter 170 is an inserter device that inserts an insertion sheet between sheets. The sheets are conveyed from the image forming device 100. The inserter 170 conveys the sheets S, also conveys an insertion sheet, and discharges them to the finisher 180. The finisher 180 is a stacker device that stacks the sheet S. The finisher 180 may execute post-processing such as a stapling process and a bookbinding process for a sheet bundle. An operation unit 190 includes an input apparatus and a display apparatus. The operation unit 190 may be referred to as an operation panel.

Control System

Figure 2:
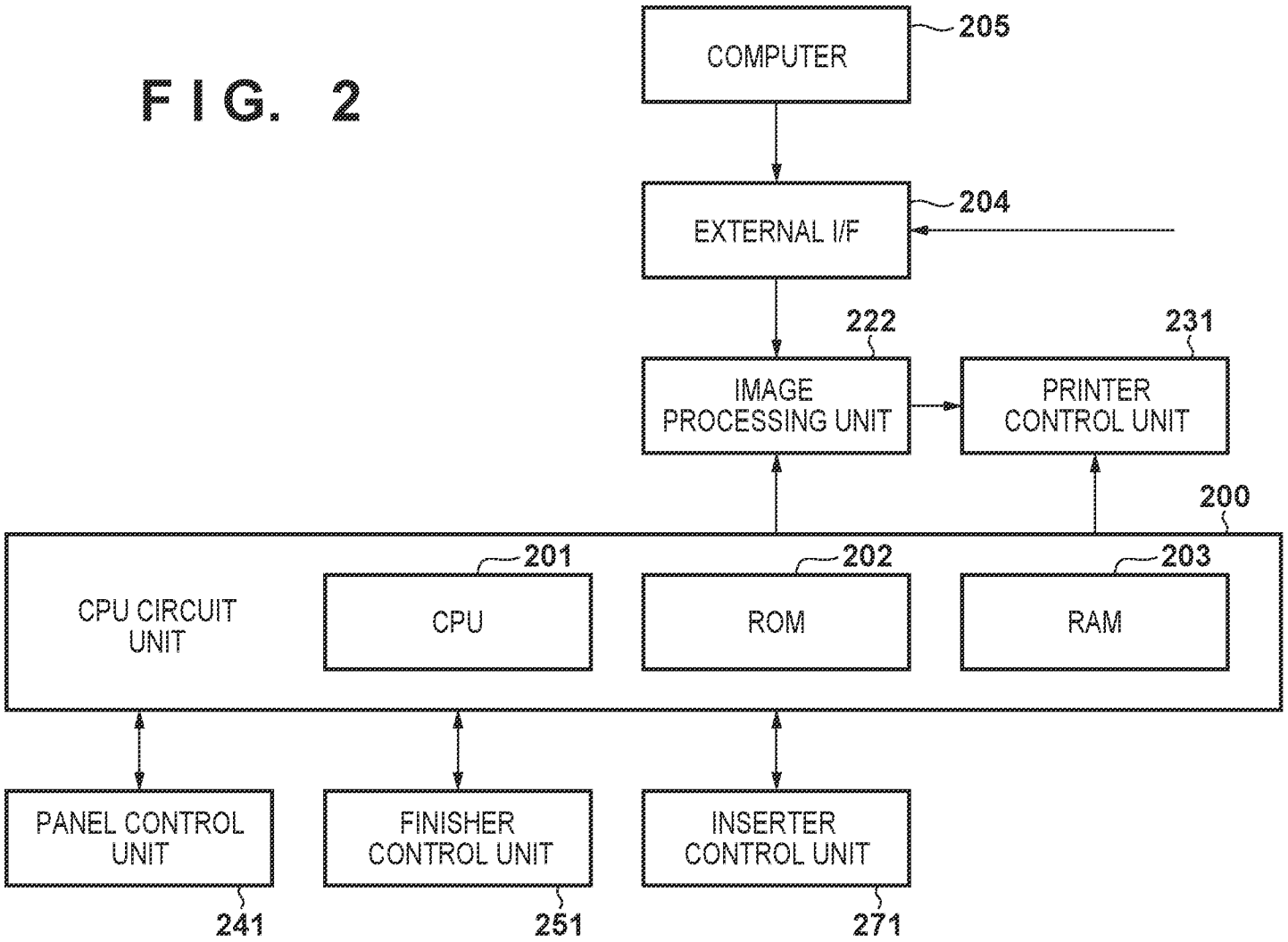
FIG. 2 is a block diagram showing a control system.

As shown in FIG. 2, a CPU circuit unit 200 includes a CPU 201, a ROM 202, and a RAM 203. The CPU 201 is a CPU (Central Processing Unit) that performs overall control of the image forming system 1. The ROM 202 is a storage apparatus that stores a control program. The RAM 203 is a storage apparatus that temporarily stores control data and the like. The CPU 201 controls, according to the control program, an image processing unit 222, a printer control unit 231, a panel control unit 241, a finisher control unit 251, and an inserter control unit 271.

The image processing unit 222 applies various types of image processing (for example, color space conversion processing and tone correction processing) to a digital image signal that is input from a computer 205 via an external I/F 204, and converts it to a video signal. The printer control unit 231 controls, based on the video signal that is output from the image processing unit 222, the image forming device 100 to form an image as well as to convey the sheet S.

The inserter control unit 271 is installed in the inserter 170. The inserter control unit 271 controls the inserter 170 by transmitting and receiving information to and from the CPU circuit unit 200. The finisher control unit 251 is installed in the finisher 180. The finisher control unit 251 controls the finisher 180 by transmitting and receiving information to and from the CPU circuit unit 200.

The panel control unit 241 transmits and receives information to and from the operation unit 190 and the CPU circuit unit 200. The operation unit 190 includes the input apparatus for setting various types of functions related to image forming and the display apparatus for displaying the states of settings and the like. The panel control unit 241, for example, outputs a key signal to the CPU circuit unit 200 according to operations performed on input keys and displays corresponding information, based on the signal transmitted from the CPU circuit unit 200, in the operation unit 190.

Operation Portion

Figure 3A:
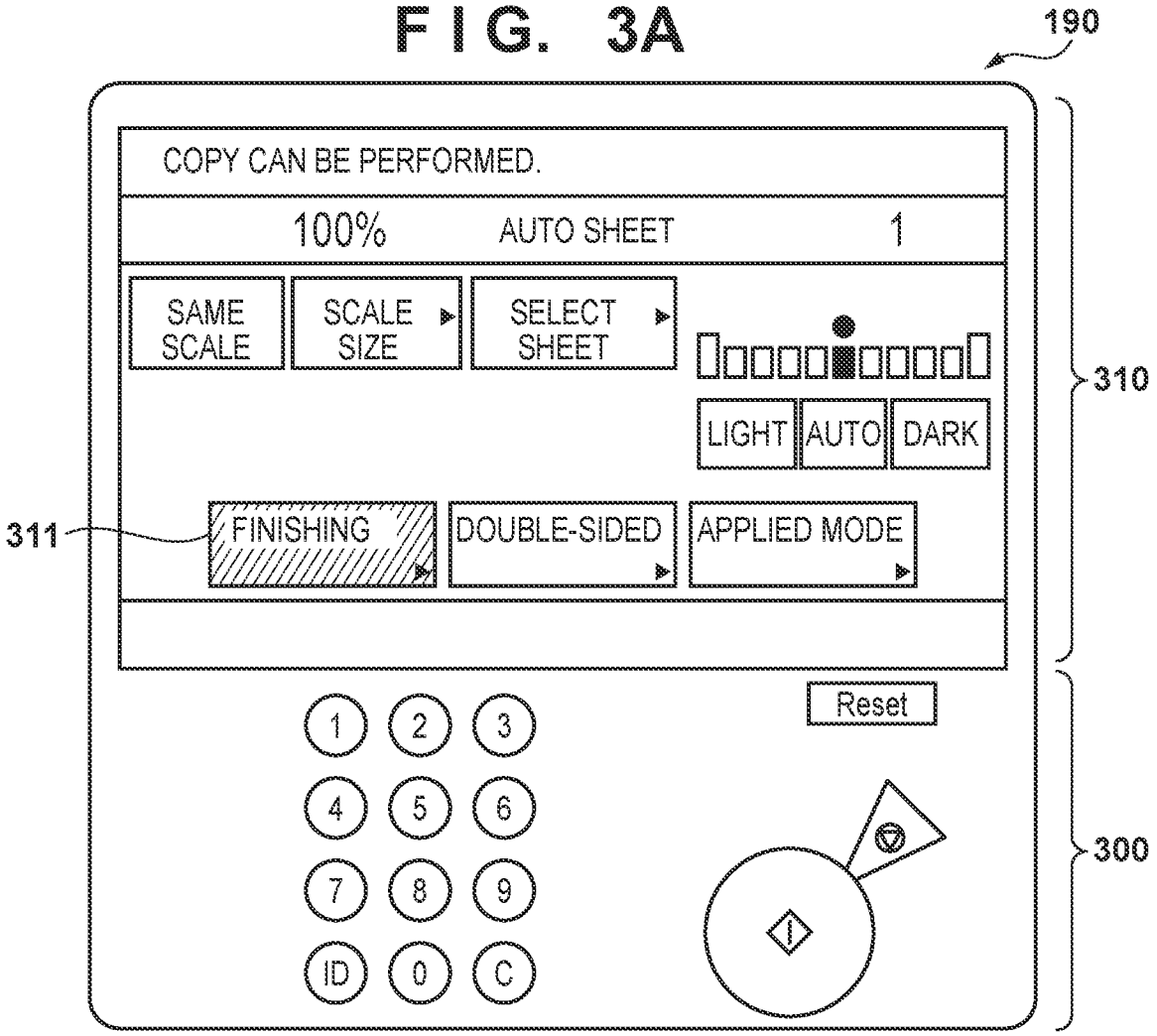
FIGS. 3A and 3B are diagrams illustrating an operation unit.
Figure 3B:
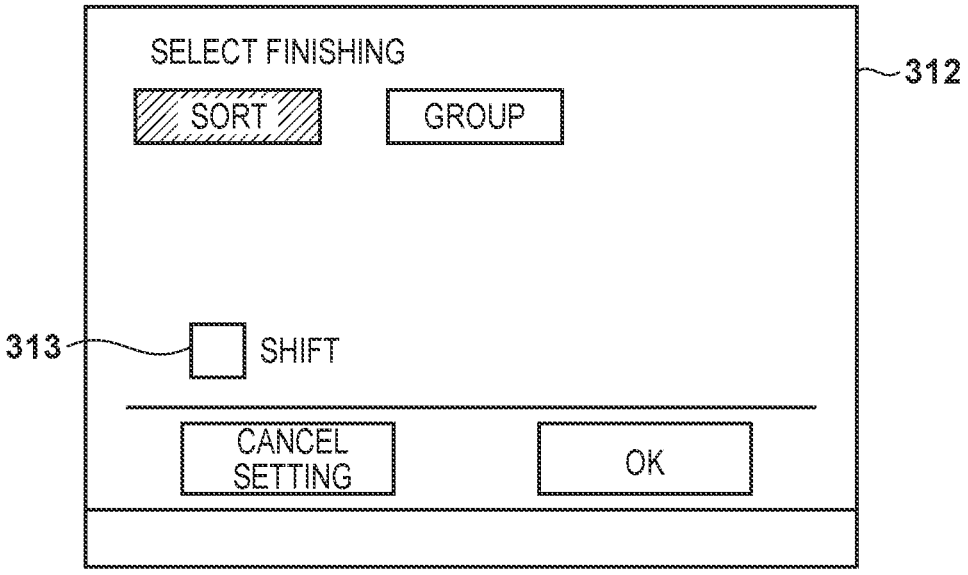

As shown FIG. 3A, an input apparatus 300 of the operation unit 190 includes a start key for starting image forming, a stop key for interrupting image forming, a numerical keypad, and the like. A display apparatus 310 displays various types of information and also displays software keys such as a finishing key 311. Note that a pressure-sensitive or electrostatic capacitance input panel may be provided over the display apparatus 310. The input panel is a part of the input apparatus 300. Upon receiving a signal indicating that the finishing key 311 was operated from the input apparatus 300 via the panel control unit 241, the CPU 201 displays a menu screen 312 as shown in FIG. 3B on the display apparatus 310. An operator sets the presence/absence of post-processing such as sorting, and the presence/absence of the insertion of an insertion sheet and the like through the menu screen.

Inserter

Figure 4B:
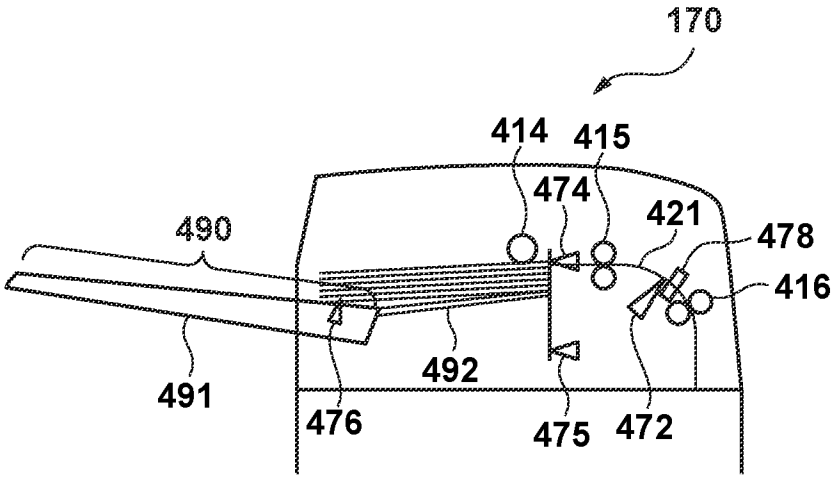
FIGS. 4A and 4B are schematic cross-sectional views showing an inserter.
Figure 4A:
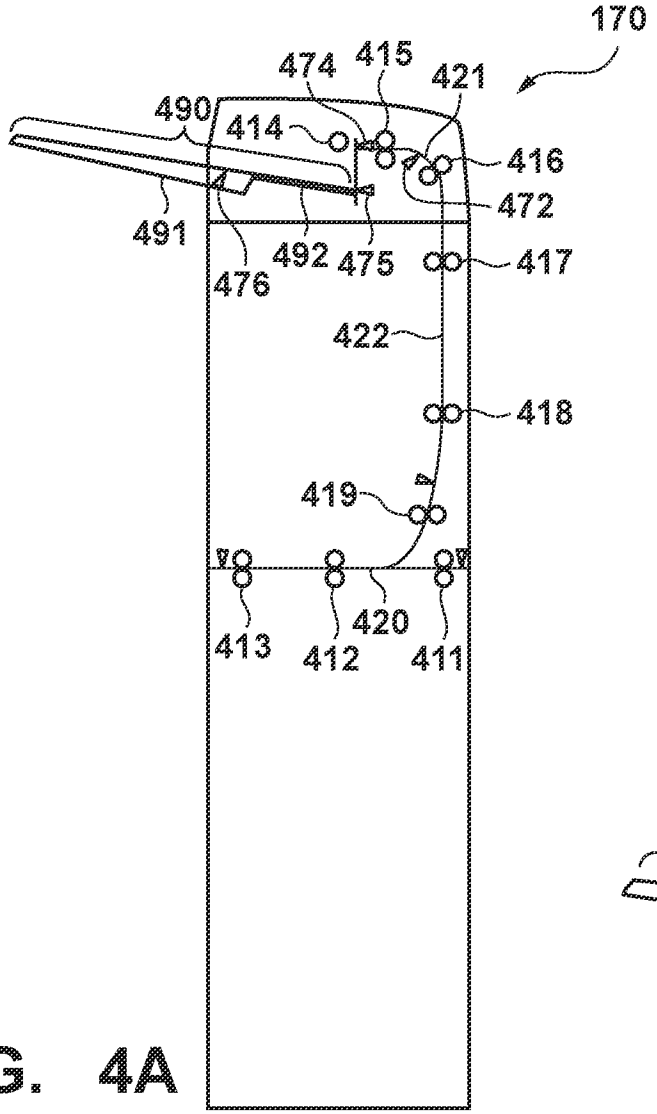

As shown in FIGS. 4A and 4B, the inserter 170 conveys, to the finisher 180, the sheet S discharged from the image forming device 100 and an insertion sheet fed from an insertion sheet tray 490. A conveyance roller pair 411 takes the sheet S discharged from the image forming device 100 in a bypass 420. Conveyance roller pairs 412 and 413 convey the sheet S taken in the inserter 170 and discharge it to the finisher 180.

The insertion sheet tray 490 is a stacking unit that stacks insertion sheets. The insertion sheet tray 490 includes a fixed plate 491 of which angle is fixed and a movable plate 492 that can freely rise and fall. The movable plate 492 rises until an insertion sheet is detected by a surface sensor 474. When an insertion sheet is detected by the surface sensor 474, the insertion sheet positioned at the uppermost position among the insertion sheets comes into contact with a pick roller 414. In the state where an insertion sheet is being detected by the surface sensor 474, by rotation of the pick roller 414, the insertion sheet positioned at the uppermost position is fed to a feeding path 421.

If a plurality of insertion sheets are fed, a separation roller pair 415 separates only one insertion sheet from them and conveys it to the downstream side. Conveyance roller pairs 416, 417, 418, and 419 convey the insertion sheet along an insertion sheet conveyance path 422 and send it to the bypass 420. After that, the insertion sheet is conveyed to the finisher 180 by the conveyance roller pairs 412 and 413.

At the timing when a feeding sensor 472 detects the leading end of an insertion sheet, the existence of the insertion sheet is confirmed. The inserter 170 notifies the image forming device 100 of "confirmation of sheet presence". This is realized by the inserter 170 transmitting an existence confirmation signal to the image forming device 100. An insertion sheet stacking surface of the fixed plate 491 is provided with a presence/absence sensor 476 that detects the presence/absence of an insertion sheet. The presence/absence of the insertion sheet on the insertion sheet tray 490 may be confirmed at the timing when the feeding sensor 472 detects the rear end of an insertion sheet. If the presence/absence sensor 476 has not detected an insertion sheet, the inserter 170 informs the image forming device 100 of "absence of an insertion sheet". "Absence of an insertion sheet" means that no insertion sheet exists on the insertion sheet tray 490. Also, the inserter 170 lowers the movable plate 492 until an HP sensor 475 detects the movable plate 492, and waits for insertion sheets to be added. If the presence/absence sensor 476 detects an insertion sheet but the surface sensor 474 does not detect the surface of the sheet, the inserter 170 lifts up the movable plate 492 until the surface sensor 474 detects the surface of the sheet.

If feeding of an insertion sheet fails, the sheet S that is to be discharged to the finisher 180 after an insertion sheet may remain in the image forming device 100. Accordingly, at the timing when the feeding sensor 472 detects the leading end of an insertion sheet, "confirmation of sheet presence" is notified to the image forming device 100. However, in the case where an escape mechanism for the sheet S is provided, the image forming system 1 can be stopped without the sheet S remaining inside the device. In this case, if the presence/absence sensor 476 has detected an insertion sheet at the timing when the feeding sensor 472 detected the rear end of the insertion sheet, the inserter 170 may notify "confirmation of sheet presence". A media sensor 478 is an optional part, and is a sensor that detects the type of an insertion sheet (for example, its grammage and thickness).

Inserter Control Portion

Figure 5:
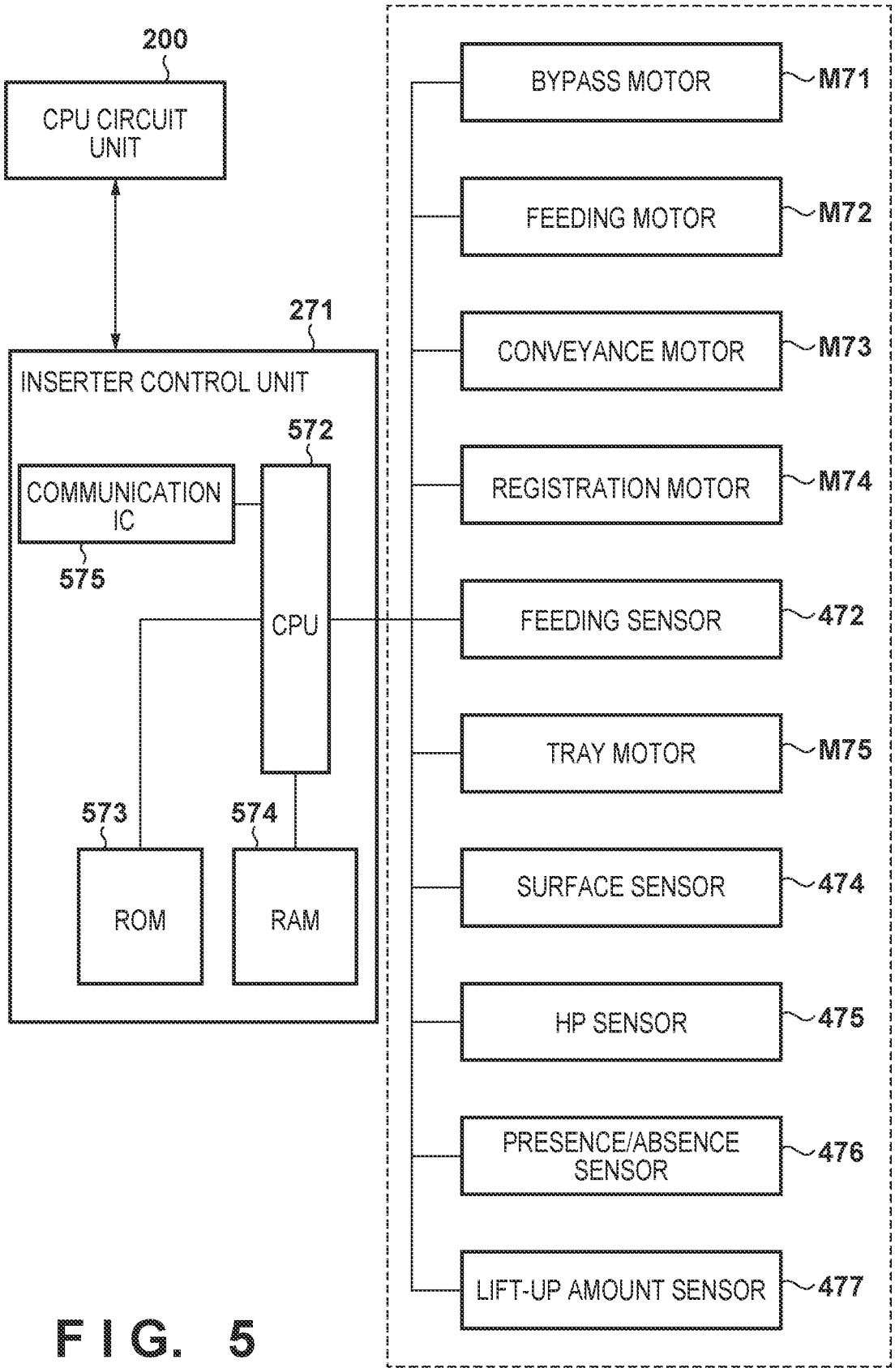
FIG. 5 is a diagram illustrating an inserter control unit.

As shown in FIG. 5, the inserter control unit 271 includes a CPU 572, a ROM 573, a RAM 574 and the like. The CPU 572 transmits and receives data and commands to and from the CPU circuit unit 200, which is provided on the image forming device 100 side, via a communication IC 575. Based on an instruction from the CPU circuit unit 200, the CPU 572 executes various types of programs stored in the ROM 573 and controls each portion of the inserter 170. The following motors and sensors are connected to the CPU 572. A bypass motor M71 drives the conveyance roller pairs 411, 412, and 413. A feeding motor M72 drives the pick roller 414, the separation roller pair 415, and the conveyance roller pair 416. A conveyance motor M73 drives the conveyance roller pair 417 and 418. A registration motor M74 drives a conveyance roller pair 419 that is called a registration roller pair. The CPU 572 judges whether or not feeding of an insertion sheet has succeeded using the feeding sensor 472.

A tray motor M75 is a motor for lifting up and lowering the movable plate 492. The CPU 572 drives the tray motor M75 to lift up the movable plate 492 until the surface sensor 474 detects the insertion sheet positioned at the uppermost position. Also, in the case where the presence/absence sensor 476 cannot detect an insertion sheet, the CPU 572 drives the tray motor M75 to lower the movable plate 492 until the HP sensor 475 detects the movable plate 492. The CPU 572 may detect the lift-up amount of the movable plate 492 with respect to HP (Home Position) using a lift-up amount sensor 477. The lift-up amount is a parameter that is correlated with the position of the movable plate 492, and it is inversely proportional to the height of the insertion sheet bundle. The lift-up amount sensor 477 may be replaced with a counter circuit that measures a driving amount of the tray motor M75 (a rotating amount and the number of supplied driving pulses). The CPU 572 calculates the remaining amount of insertion sheets [%] according to the lift-up amount and stores it in the RAM 574. For example, every time the remaining amount of insertion sheets changes, the CPU 572 notifies the remaining amount of insertion sheets to the CPU circuit unit 200.

Finisher

Figure 6:
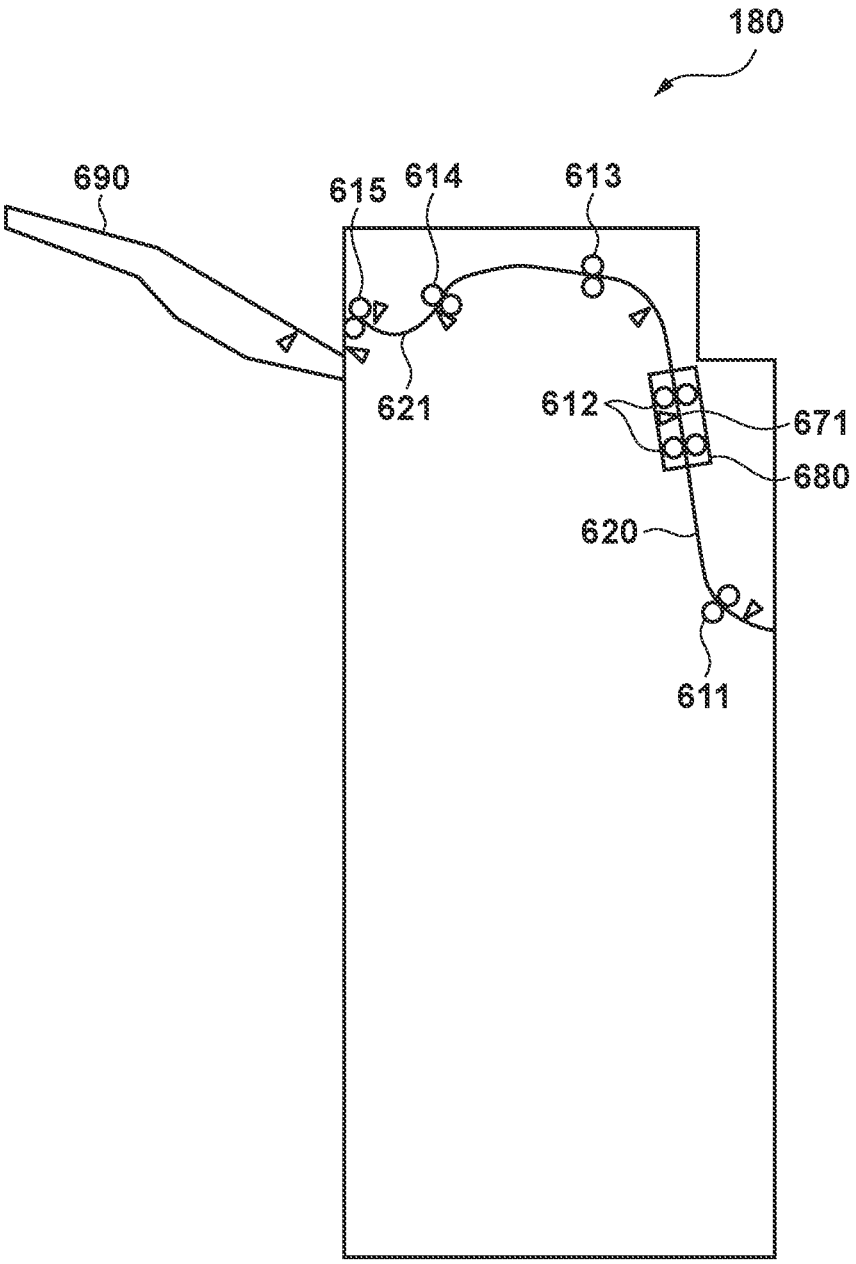
FIG. 6 is a schematic cross-sectional view showing a finisher.

As shown in FIG. 6, the finisher 180 is a stacker device that stacks the sheet S and an insertion sheet discharged from the inserter 170. A conveyance roller pair 611 takes the sheet S and an insertion sheet discharged from the inserter 170 in a conveyance path 620. Conveyance roller pairs 612 and 613 convey the sheet S and an insertion sheet further downstream along the conveyance path 620.

The conveyance roller pair 612 is provided at a shift unit 680 together with a conveyance sensor 671. The shift unit 680 can move in the width direction orthogonal to the conveyance direction by a shift motor M4 shown in FIG. 7. By the shift motor M4 rotating in the state where the conveyance roller pair 612 sandwiches the sheet S, the sheet S moves in the width direction while being conveyed. This movement is called "offset". When the operator selects a sort mode and presses a shift key 313 shown in FIG. 3B, the shift unit 680 offsets the sheet S. For example, in the case of forward shift, the sheet S and an insertion sheet are offset by 15 mm forward from a reference position. In the case of backward shift, the sheet S and an insertion sheet are offset by 15 mm backward from the reference position. If the shift key 313 is not pressed, the shift unit 680 causes the sheet S and an insertion sheet to pass as-is without executing the offset. When the conveyance sensor 671 detects that the sheet S and an insertion sheet have passed the shift unit 680, the shift motor M4 is driven, and the shift unit 680 returns to a center position. A conveyance roller pair 614 conveys the sheet S that was offset by the shift unit 680 to a discharge path 621. A conveyance roller pair 615 discharges the sheet S and an insertion sheet to a stacking tray 690.

Finisher Control Portion

Figure 7:
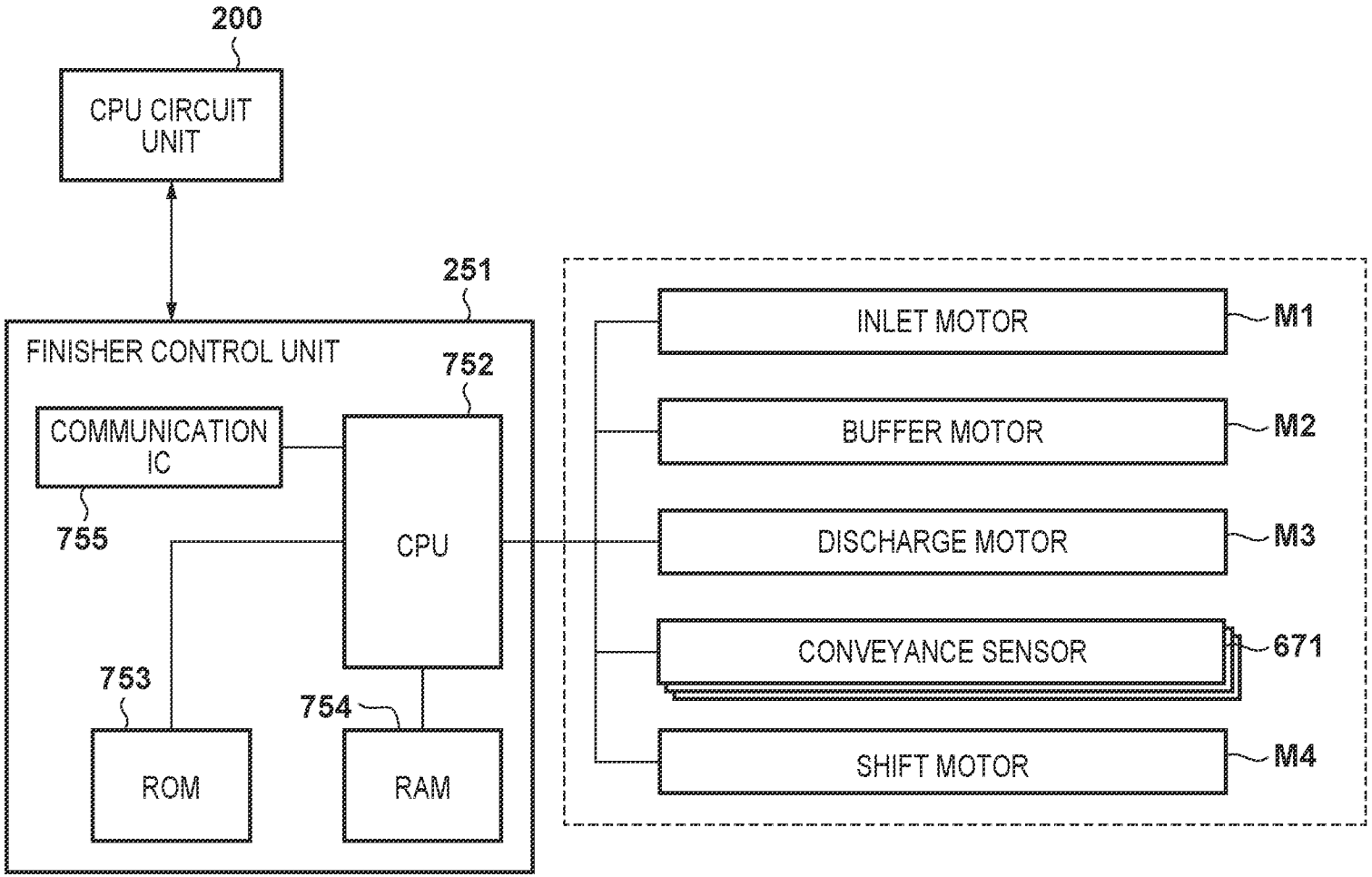
FIG. 7 is a diagram illustrating a finisher control unit.

As shown in FIG. 7, the finisher control unit 251 includes a CPU 752, a ROM 753, a RAM 754 and the like. The CPU 752 transmits and receives data, commands, and the like to and from the CPU circuit unit 200 via a communication IC 757. Based on an instruction from the CPU circuit unit 200, the CPU 752 controls a motor and the like of the finisher 180 by executing various types of programs stored in the ROM 753.

An inlet motor M1 drives the conveyance roller pairs 611, 612, and 613. A buffer motor M2 drives the conveyance roller pair 614. A discharge motor M3 drives the conveyance roller pair 615. A shift motor M4 drives the shift unit 680. The CPU 752 detects that the sheet S and an insertion sheet have arrived at the shift unit 680 using the conveyance sensor 671.

Judgment of Type of Insertion Sheet

Several methods exist for judging the type of an insertion sheet. For example, the CPU 572 may obtain a type related to the thickness of an insertion sheet using the media sensor 478 that is provided at the feeding path 421. This type of media sensor 478 includes a light emitting element and a photodetection element and obtains a light reception amount at the photodetection element. Because the light reception amount is correlated with the thickness of an insertion sheet and its grammage, the CPU 572 can convert the light reception amount to type information of the thickness and the grammage and the like. Alternatively, as described below, the CPU 201 may obtain the type of an insertion sheet according to information that was input by the operator through the operation unit 190.

Figure 8A:
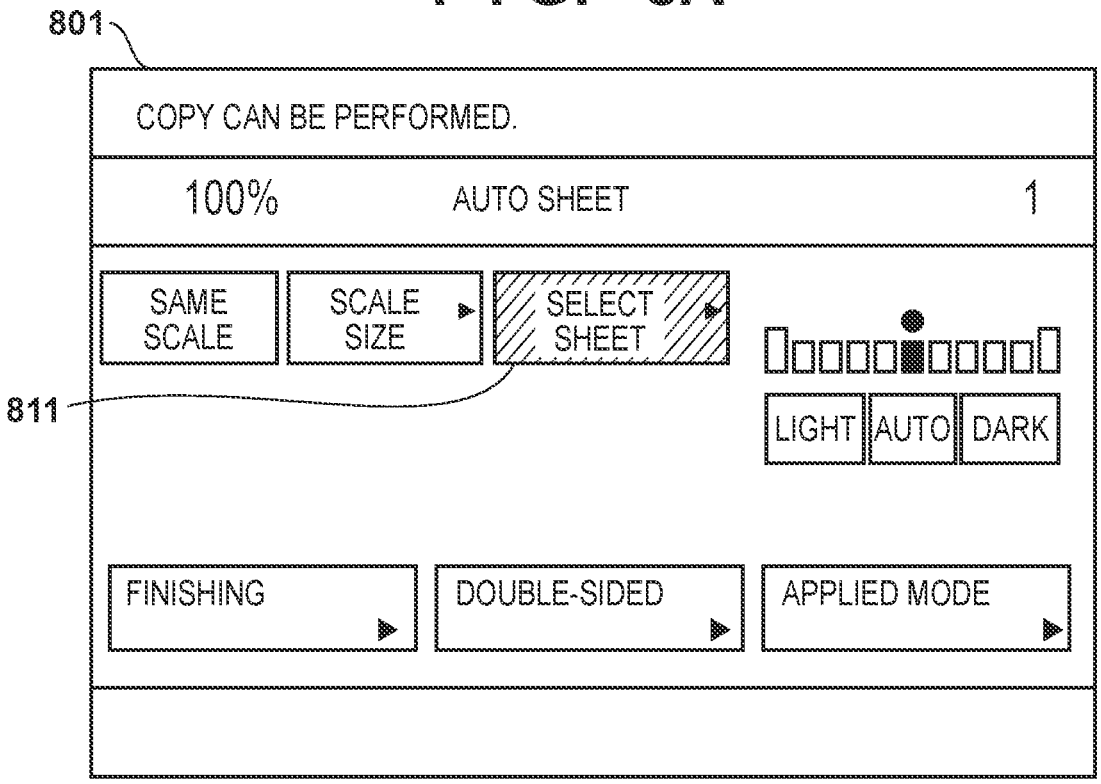
FIGS. 8A to 8D are diagrams illustrating a user interface (UI).
Figure 8B:
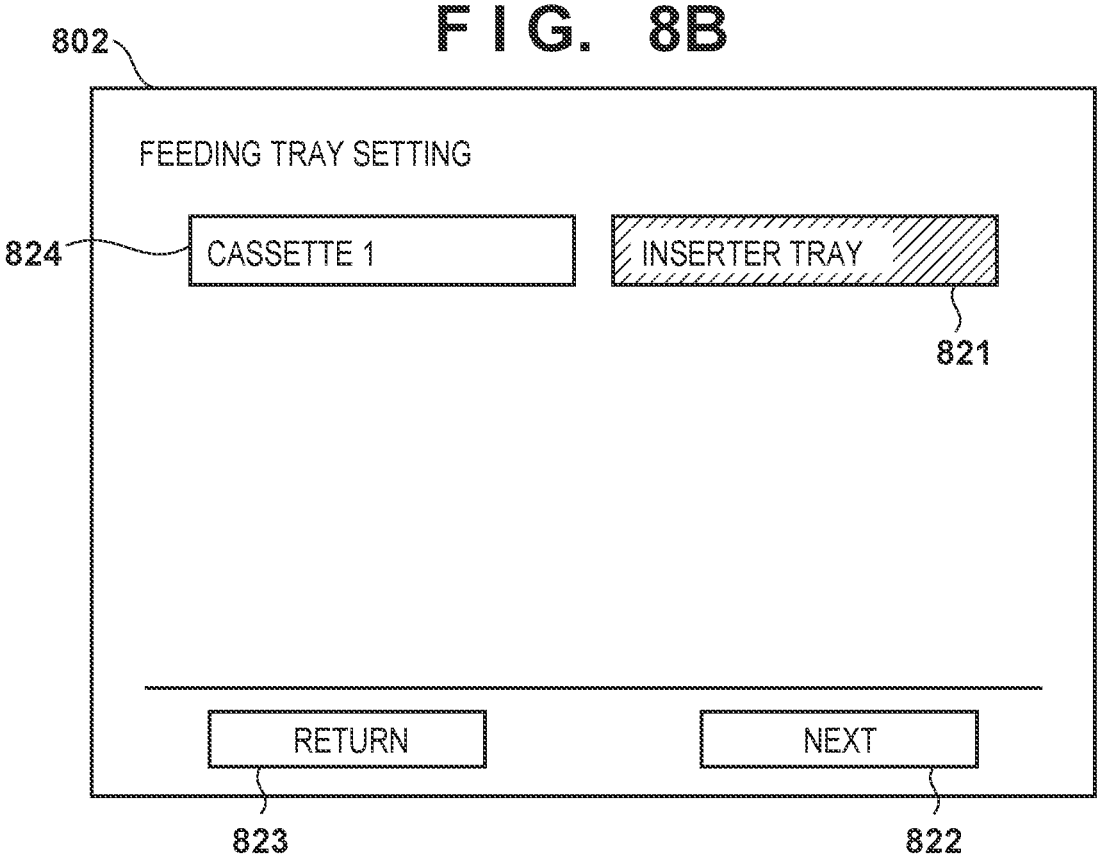

As shown in FIG. 8A, the CPU 201 causes the display apparatus 310 to display an initial UI 801 through the panel control unit 241. When the CPU 201 recognizes that the operator pressed a software key 811 indicating "Select sheet" in the initial UI 801, the CPU 201 causes the display apparatus 310 to display a feeding tray setting UI 802 as shown in FIG. 8B.

Figure 8C:
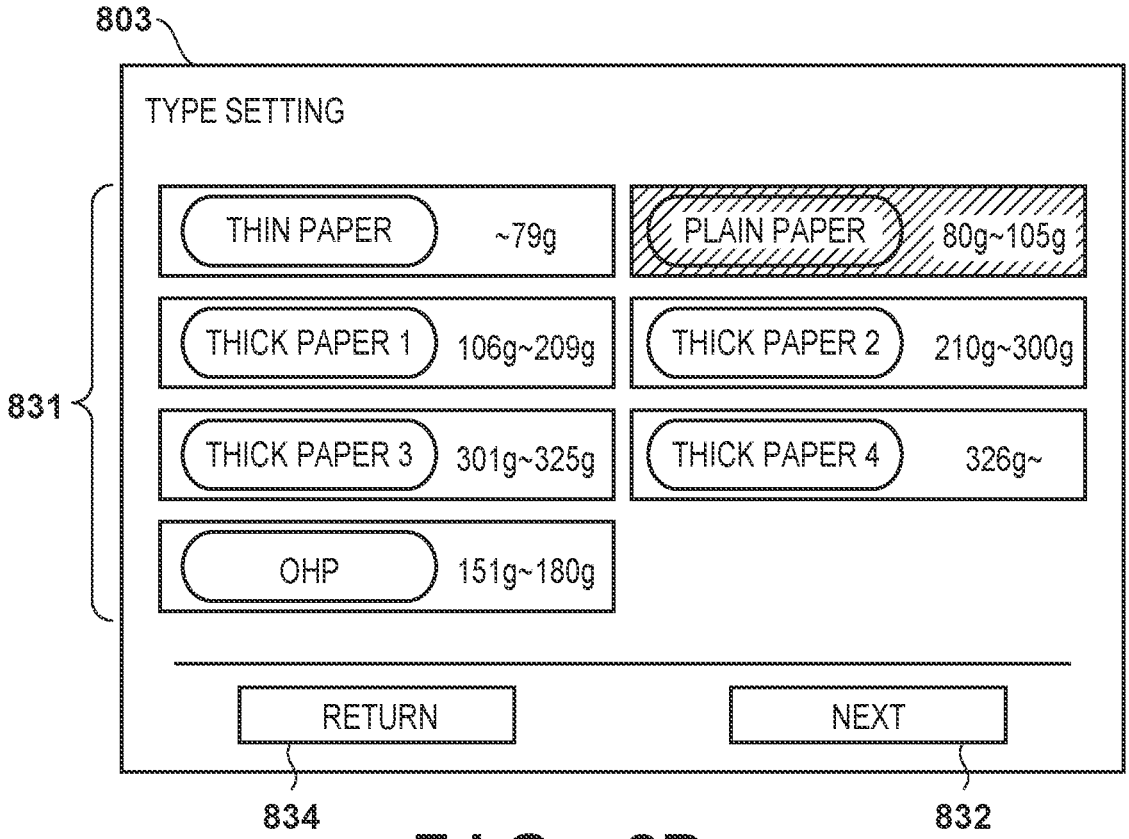

When the operator presses a software key 821 indicating "Inserter tray" and presses a software key 822 indicating "Next" in the feeding tray setting UI 802, the CPU 201 causes the display apparatus 310 to display a type setting UI 803 as shown in FIG. 8C. When the operator presses a software key 823 indicating "Return" in the feeding tray setting UI 802, the CPU 201 causes the display apparatus 310 to display the initial UI 801.

Figure 8D:
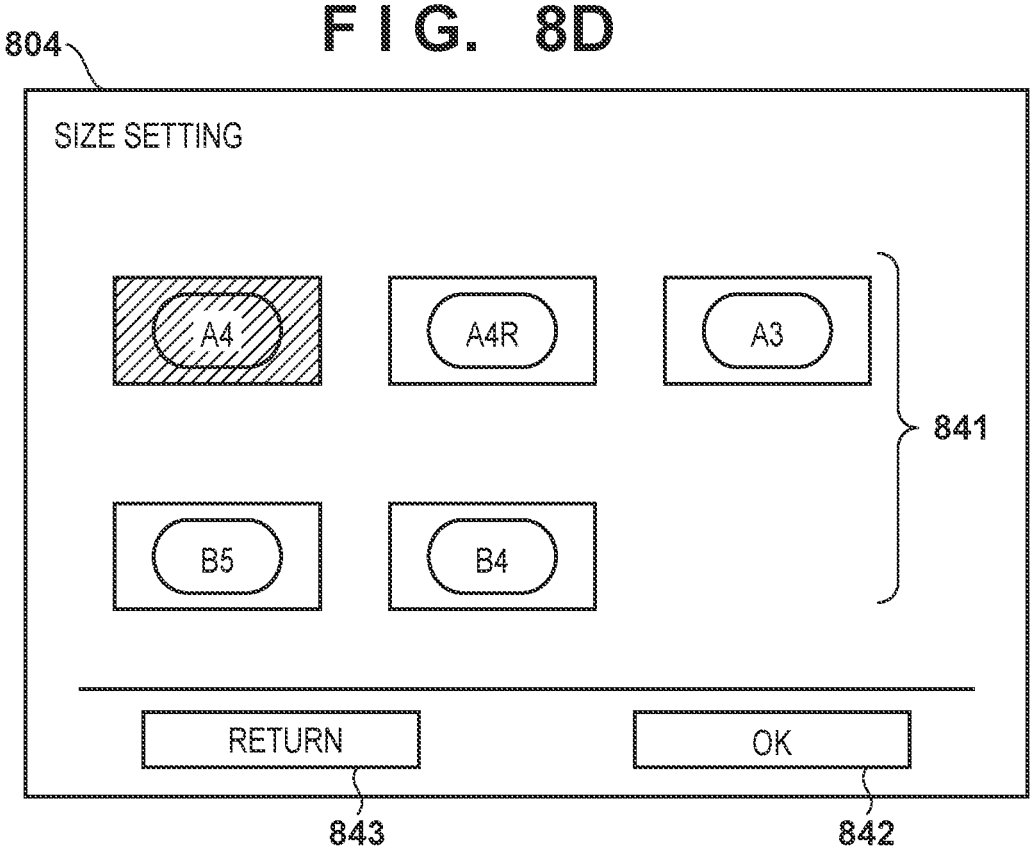

When the operator presses a software key 831 corresponding to any one of various types and presses a software key 832 of "Next" in the type setting UI 803, the CPU 201 causes the display apparatus 310 to display a size setting UI 804 as shown in FIG. 8D. The CPU 201 stores the type information corresponding to the pressed software key 831 in the RAM 203. If the operator presses a software key 834 indicating "Return" in the type setting UI 803, the CPU 201 displays the feeding tray setting UI 802 on the display apparatus 310.

When the operator presses a software key 841 corresponding to any one of various sizes and presses a software key 842 of "OK", the CPU 201 causes the display apparatus 310 to display the initial UI 801. The CPU 201 stores size information corresponding to the pressed-down software key 841 in the RAM 203. When the operator presses a software key 843 indicating "Return", the CPU 201 causes the display apparatus 310 to display the type setting UI 803. When the operator presses a software key 824 indicating "Cassette 1" in the feeding tray setting UI 802, the CPU 201 accepts the settings for the type and size of the sheet S stored in the feeding tray of the image forming device 100.

Feeding Flow

Figure 9:
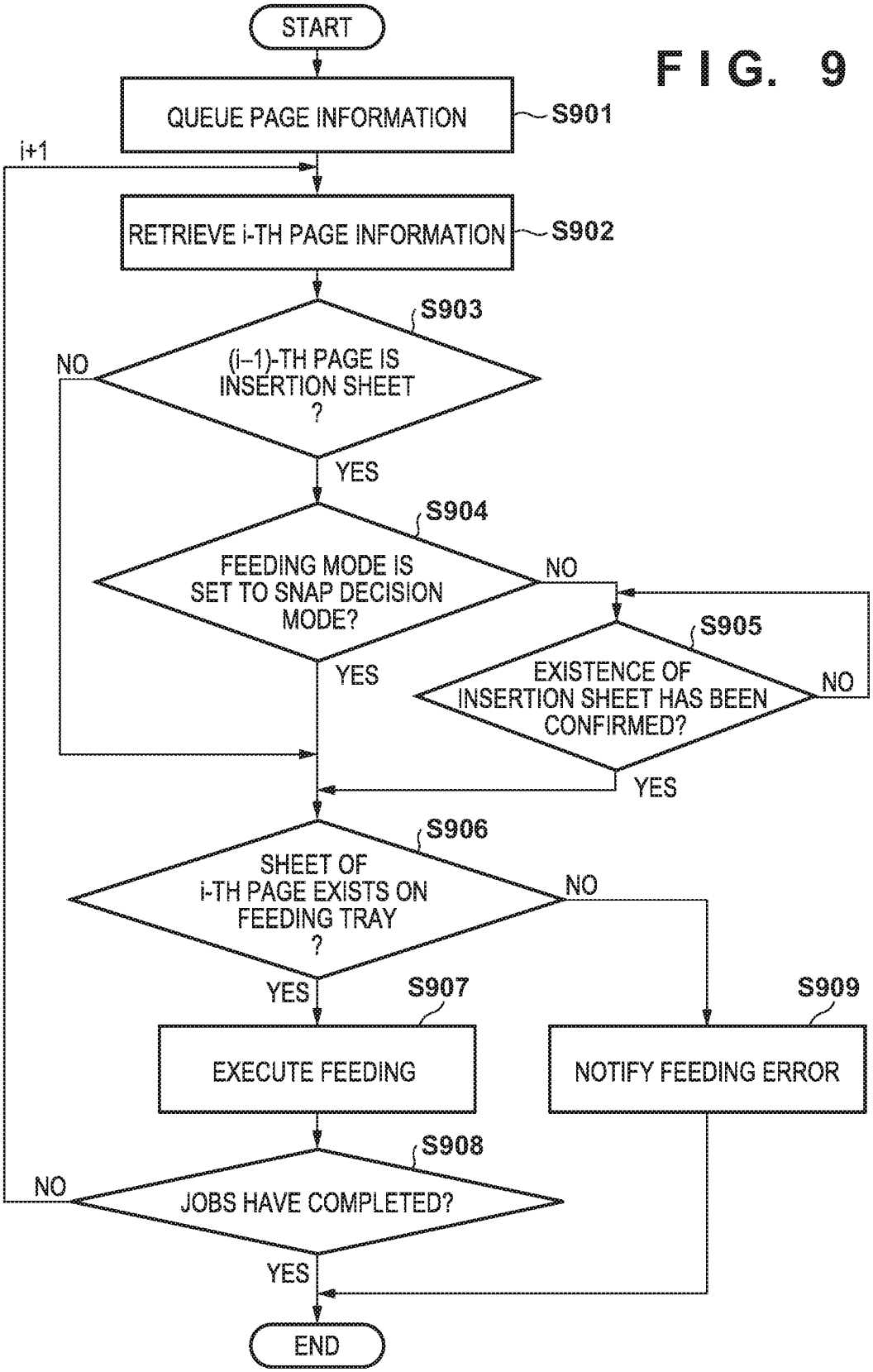
FIG. 9 is a flowchart illustrating feeding control.

Feeding control of the sheet S and an insertion sheet that is executed by the CPU 201 is described below with reference to FIG. 9.

In step S901, the CPU 201 analyzes image forming jobs received from the computer 205 and queues page information of each page in a queue. The queue is retained in the RAM 203. The page information contains information indicating a feeding unit that is to feed the pages (the sheet storage 103 and the inserter 170). Then, the CPU 201 initializes various types of control parameters held in a ROM 903.

In step S902, the CPU 201 retrieves the page information of an i-th page from the queue. 'i' is an integer from 1 to N. N is the total number of sheets of the sheets S and insertion sheets that are to be discharged to the finisher 180 according to the image forming jobs. Note that the CPU 201 temporarily holds the page information of the i-th page retrieved from the queue in the RAM 203. In addition, if the i-th page is a process target, it is assumed that page information of an (i−1)-th page is also held in the RAM 203 (note that 'i' is two or larger). The (i−1)-th page may be called previous paper, previous sheet, or previous page.

In step S903, the CPU 201 reads out the page information of the (i−1)-th page from the RAM 203, analyzes it, and judges whether or not the (i−1)-th page is an insertion sheet. If the (i−1)-th page is an insertion sheet, the CPU 201 moves the process to step S904. If the (i−1)-th page is the sheet S (transfer sheet), rather than an insertion sheet, the CPU 201 skips steps S904 and S905 and moves the process to step S906.

In step S904, the CPU 201 reads out information of the feeding mode saved in the RAM 903, and judges whether or not the feeding mode is set to the snap decision (non-confirmation) mode. The snap decision (non-confirmation) mode is a feeding mode in which the CPU 201 executes the feeding of the i-th page without confirming that an insertion sheet, which is the (i−1)-th page to be inserted before the i-th page, exists in the inserter 170. Also, the confirmation mode is a feeding mode in which the CPU 201 executes the feeding of the i-th page after confirming that an insertion sheet, which is the (i−1)-th page to be inserted before the i-th page, exists in the inserter 170. If the snap decision (non-confirmation) mode has been selected as the feeding mode, the CPU 201 skips step S905 and moves the process to step S906. On the other hand, if the snap decision (non-confirmation) mode has not been selected as the feeding mode, the CPU 201 moves the process to step S905.

In step S905, the CPU 201 judges whether or not the existence of an insertion sheet, which is the (i−1)-th page, has been confirmed. For example, if the existence confirmation signal has been received from the inserter control unit 271, the CPU 201 judges that the existence of the insertion sheet is confirmed and moves the process to step S906. On the other hand, if the existence confirmation signal has not been received from the inserter control unit 271 yet, the CPU 201 waits for the existence confirmation signal.

In step S906, the CPU 201 judges whether or not a sheet for the i-th page exists in the feeding unit (feeding tray). For example, if the i-th page is the sheet S, the CPU 201 judges whether or not the sheet S exists in the sheet storage 103 based on a detection signal output from the sheet sensor 102. If the i-th page is an insertion sheet, the CPU 201 judges whether or not an insertion sheet exists in the inserter 170 based on a signal output from the inserter control unit 271. If a sheet for the i-th page does not exist, the CPU 201 moves the process to step S909. In step S909, the CPU 201 causes the display apparatus 310 to display a feeding error. For example, the display apparatus 310 may display a message for prompting replenishment of the sheet S. If a sheet for the i-th page exists, the CPU 201 moves the process to step S907.

In step S907, the CPU 201 executes the feeding of a sheet for the i-th page. If the i-th page is the sheet S, the CPU 201 rotates the pickup roller 101 to feed the sheet S from the sheet storage 103 to the conveyance path. The CPU 201 controls the image forming device 100 to form an image on the sheet S. If the i-th page is an insertion sheet, the CPU 201 transmits a feeding instruction to the inserter control unit 271.

In step S908, the CPU 201 judges whether or not all of the image forming jobs are complete. For example, if page information does not remain in the queue, the CPU 201 ends the image forming. If all of the image forming jobs are not complete, the CPU 201 adds 1 to i and returns the process to step S902.

Setting of Feeding Mode

Figure 10:
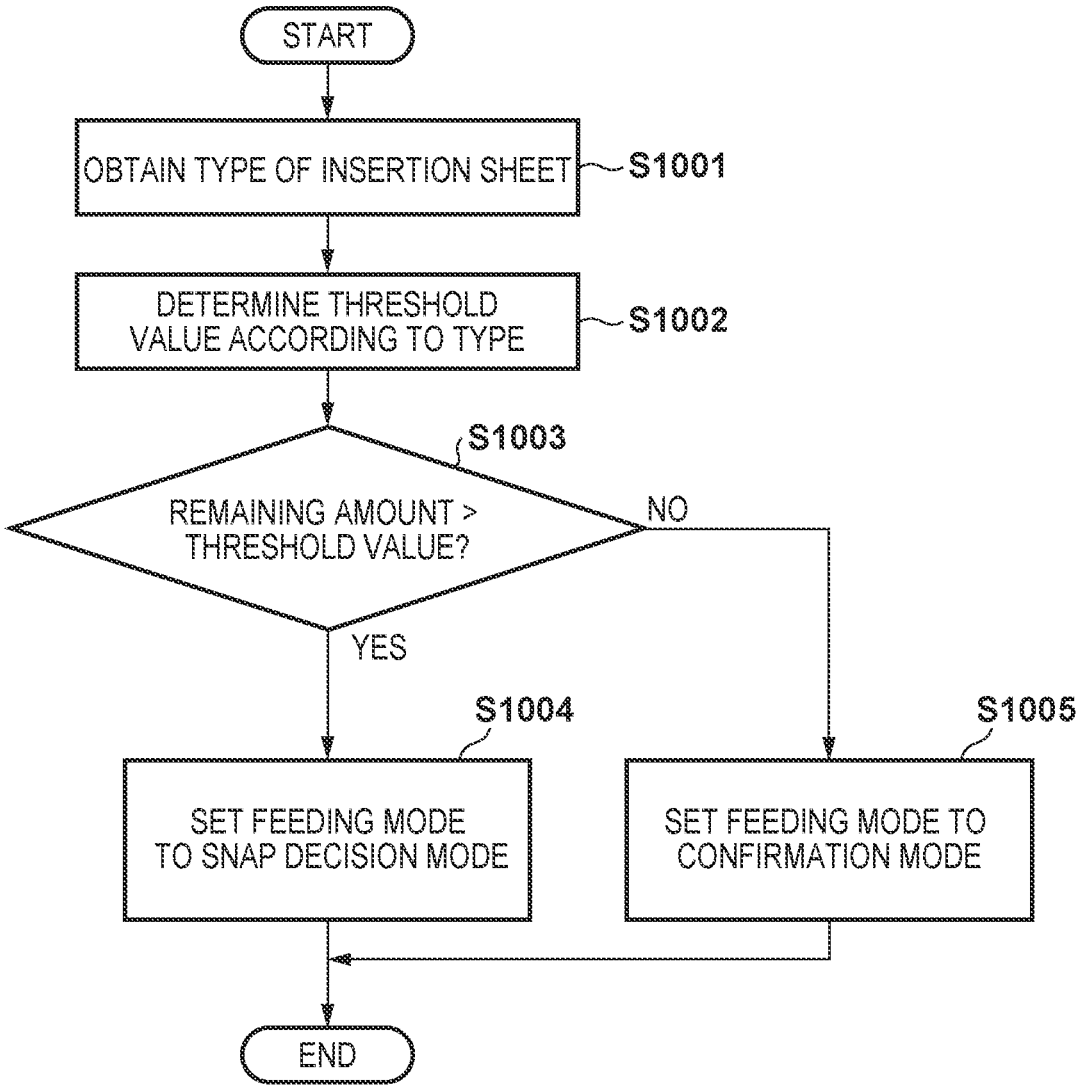
FIG. 10 is a flowchart illustrating processing for setting a feeding mode.

Processing for setting the feeding mode executed by the CPU 201 is described below with reference to FIG. 10. When a remaining amount notification is received from the inserter control unit 271, the CPU 201 executes the setting processing.

In step S1001, the CPU 201 obtains insertion sheet type information from the RAM 903. Here, as one example, it is assumed that the type information is the grammage.

In step S1002, the CPU 201 determines a threshold value that is in accordance with the type information. This threshold value may be called a remaining amount threshold value. The CPU 201 may use a table or a function for converting the grammage and the thickness to the threshold value.

FIGS. 11A and 11B show examples of the conversion table. The conversion table is held in the ROM 202. The conversion table shown in FIG. 11A is a table for converting the grammage to the threshold value [%]. The conversion table shown in FIG. 11B is a table for converting a sheet type such as thin paper and plain paper to the threshold value [%]. If the type information shows the sheet type, the conversion table shown in FIG. 11B is used. The larger the grammage is, the thicker the sheet thickness is. Accordingly, the threshold value becomes larger as the grammage becomes larger.

In step S1003, the CPU 201 judges whether or not the remaining amount [%] that is notified from the inserter 170 exceeds the threshold value [%]. If the remaining amount exceeds the threshold value, a sufficient amount of insertion sheets is stacked on the insertion sheet tray 490, and therefore the CPU 201 moves the process to step S1004. On the other hand, if the remaining amount is less than or equal to the threshold value, the amount of insertion sheets stacked on the insertion sheet tray 490 is small, and therefore the CPU 201 moves the process to step S1005.

In step S1004, the CPU 201 sets the feeding mode to the snap decision (non-confirmation) mode and stores information indicating the feeding mode in the RAM 203.

In step S1005, the CPU 201 sets the feeding mode to the confirmation mode and stores information indicating the feeding mode in the RAM 203.

In this manner, the CPU 201 changes the threshold value for switching between the snap decision (non-confirmation) mode and the confirmation mode according to the grammage of an insertion sheet. Therefore, the feeding mode can be switched from the snap decision (non-confirmation) mode to the confirmation mode at an appropriate timing according to the grammage of an insertion sheet. As a result, a productivity decrease of the image forming system 1 is suppressed while also avoiding a problem caused by the running out of an insertion sheet.

Feeding Flow of Inserter

Figure 12:
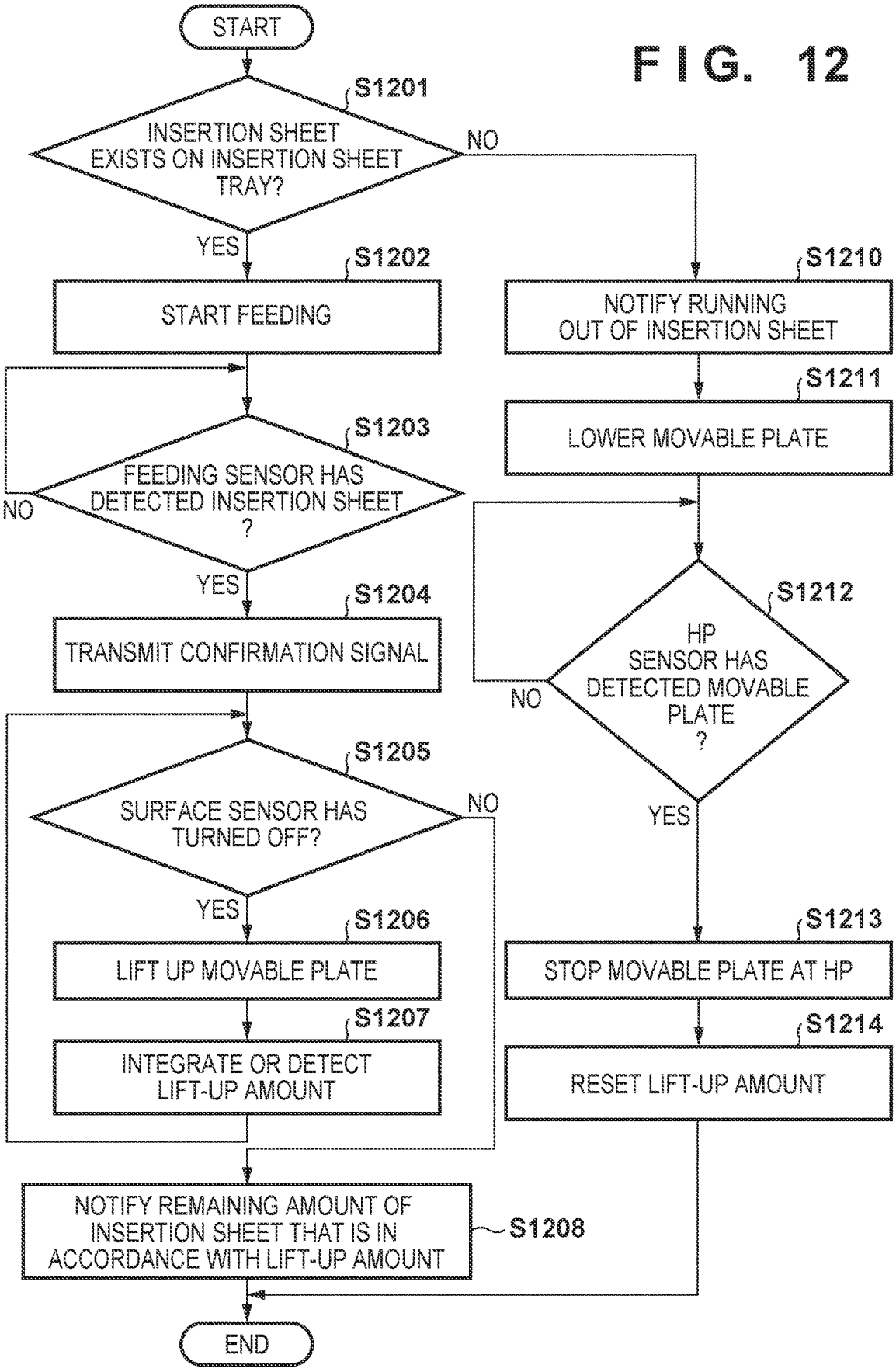
FIG. 12 is a flow chart illustrating the feeding control of the inserter.

Processing for Controlling the inserter 170 executed by the CPU 572 is described below with reference to FIG. 12. Upon receiving a feeding instruction from the CPU 201, the CPU 572 executes the following processing.

In step S1201, based on the detection result of the presence/absence sensor 476, the CPU 572 judges whether or not an insertion sheet exists on the insertion sheet tray 490. If an insertion sheet exists, the CPU 572 moves the process to step S1202. On the other hand, if an insertion sheet does not exist, the CPU 572 moves the process to step S1210.

Note that there is a case where at the time when the feeding instruction has been received from the CPU 201, feeding of a previous insertion sheet has not been completed. In this case, it is necessary for the CPU 201 to start feeding an insertion sheet after waiting for completion of the feeding of the previous insertion sheet. Thus, before the processing of step S1201, the CPU 201 may judge whether or not the feeding sensor 472 is OFF.

In step S1210, the CPU 572 notifies the CPU 201 of running out of an insertion sheet (absence of an insertion sheet). In step S1211, the CPU 572 drives the tray motor M75 to lower the movable plate 492. In step S1212, the CPU 572 judges whether or not the HP sensor 475 has detected the movable plate 492. When the HP sensor 475 detects the movable plate 492, the CPU 572 moves the process to step S1213. In step S1213, the CPU 572 stops the movable plate 492 at the home position by stopping the tray motor M75. In this manner, insertion sheets can be replenished. In step S1214, the CPU 572 resets an integrated value or a measurement value of the lift-up amount.

In step S1202, the CPU 572 starts feeding an insertion sheet by starting driving of the feeding motor M72.

In step S1203, the CPU 572 judges whether not the feeding sensor 472 has detected an insertion sheet. If the feeding sensor 472 detects an insertion sheet, the CPU 572 moves the process to step S1204.

In step S1204, the CPU 572 transmits, to the CPU 201, the existence confirmation signal indicating that the existence of the insertion sheet has been confirmed.

In step S1205, the CPU 572 judges whether or not the surface sensor 474 has turned OFF. If the surface sensor 474 cannot detect an insertion sheet, the detection signal from the surface sensor 474 switches from ON to OFF. If the surface sensor 474 has not turned OFF, the CPU 572 moves the process to step S1208. On the other hand, if the surface sensor 474 turns OFF, the CPU 572 moves the process to step S1206.

In step S1206, the CPU 572 drives the tray motor M75 to lift up the movable plate 492.

In step S1207, the CPU 572 integrates the lift-up amount of the movable plate 492 according to the driving amount of the tray motor M75 or detects the lift-up amount using the lift-up amount sensor 477. After that, the CPU 572 returns the process to step S1205.

In step S1208, the CPU 572 acquires the remaining amount of insertion sheets based on the lift-up amount and notifies that remaining amount of the CPU 201. A conversion equation or table for converting the lift-up amount to the remaining amount may be held in the ROM 573. The CPU 572 converts the lift-up amount to the remaining amount using the conversion equation or table.

Summary

Figure 13:
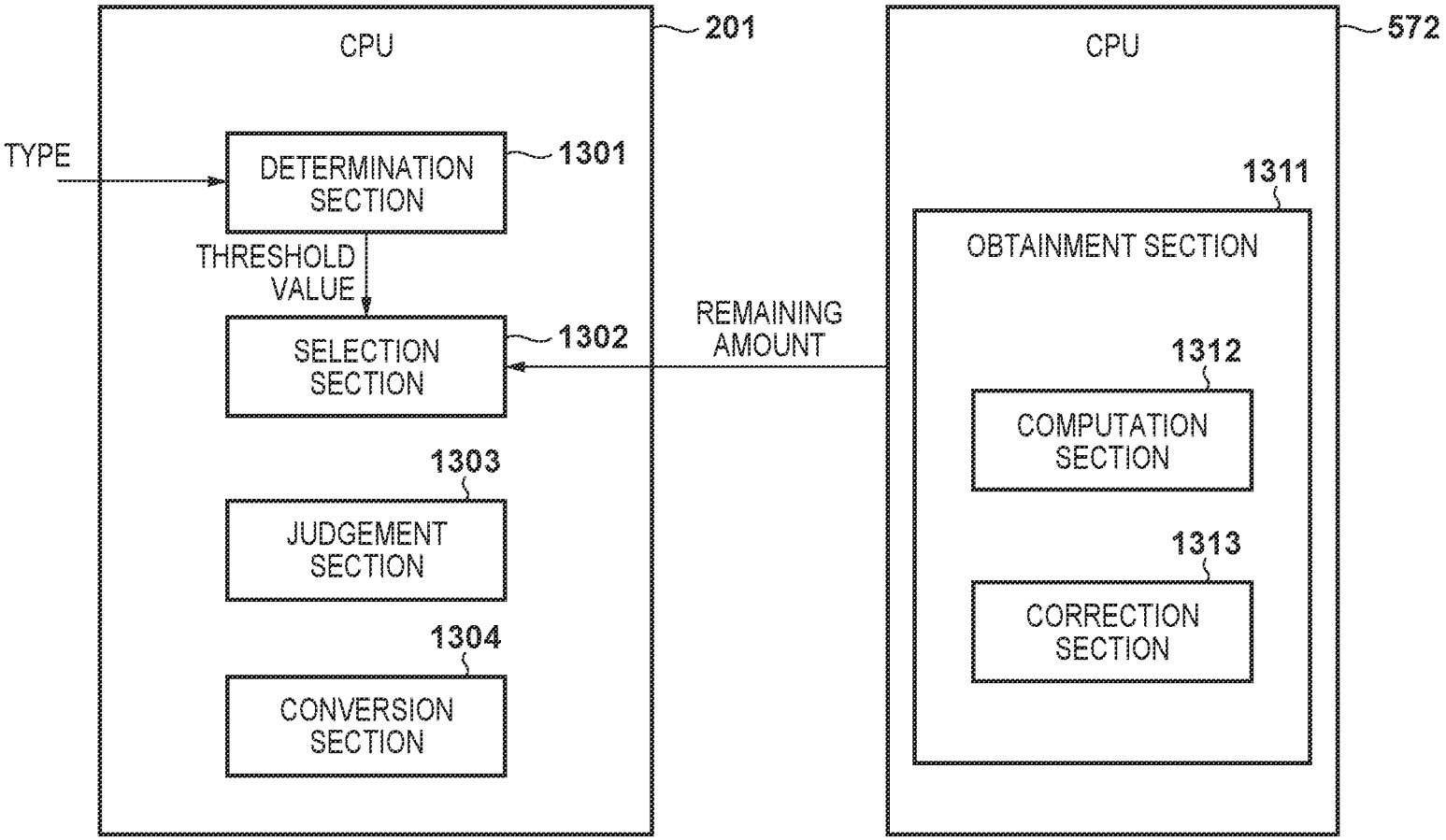
FIG. 13 is a diagram showing functions of a CPU.

FIG. 13 shows functions of the CPUs 201 and 572. A part or all of these functions may be realized by the CPUs 201 and 572 executing the control program. A part or all of these functions may be realized by a hardware circuit. Also, a part or all of the functions of the CPU 201 may be realized by the CPU 572, and a part or all of the functions of the CPU 572 may be realized by the CPU 201.

The sheet storage 103 and the pickup roller 101 of the image forming device 100 are one example of a sheet feeding unit that feeds the sheet S. The stations 120 to 123 are one example of an image forming unit that forms an image on a sheet that is fed by the sheet feeding unit. The feeding unit of the inserter 170 is one example of an insertion sheet feeding unit that feeds an insertion sheet. The CPU 572 and the lift-up amount sensor 477 are one example of an obtainment unit that obtains the remaining amount of insertion sheets held (stacked) in the insertion sheet feeding unit. Note that the insertion sheet tray 490 is one example of an insertion sheet stacking unit provided at the insertion sheet feeding unit. The CPU 201 and the CPU 572 are one example of a control unit that controls the image forming device 100, the inserter 170 and the like. As shown in step S1002, the CPU 201 includes a determination section 1301 that determines the remaining amount threshold value that is in accordance with the type of an insertion sheet. As shown in step S1003 to step S1005, the CPU 201 includes a selection section 1302 for the feeding mode. That is, if the remaining amount of insertion sheets obtained by an obtainment section 1311 is less than or equal to the remaining amount threshold value, the CPU 201 selects the confirmation mode, which is a first mode, as the feeding mode of the sheet feeding unit. If the remaining amount of insertion sheets obtained by the obtainment section 1311 is larger than the remaining amount threshold value, the CPU 201 selects the snap decision (non-confirmation) mode, which is a second mode, as the feeding mode of the sheet feeding unit. The first mode is a mode in which the sheet feeding unit feeds a sheet after it has been confirmed that an insertion sheet, which is to be inserted by the inserter device immediately prior to a sheet fed from the sheet feeding unit, exists in the insertion sheet feeding unit. That is, the first mode is a mode in which the sheet feeding unit starts feeding a sheet based on the presence/absence of an insertion sheet. The second mode is a mode in which the sheet feeding unit feeds the sheet by skipping the process in which it is confirmed that the insertion sheet, which is to be inserted by the inserter device immediately prior to the sheet fed from the sheet feeding unit, exists in the insertion sheet feeding unit. That is, the second mode is a mode in which the sheet feeding unit starts feeding the sheet regardless of the presence/absence of the insertion sheet. As described above, according to this embodiment, the feeding mode is appropriately selected in accordance with the remaining amount of insertion sheets. As a result, it is expected that a problem caused when an insertion sheet runs out is prevented and a productivity decrease is also suppressed.

The insertion sheet tray 490 of the inserter 170 is one example of an insertion sheet holding unit that holds an insertion sheet. The presence/absence sensor 476 is one example of an existence detection unit that detects whether or not an insertion sheet exists in the insertion sheet holding unit. In the first mode, the CPU 201 may confirm that an insertion sheet exists in the insertion sheet feeding unit using the existence detection unit. Also, the CPU 201 may detect that an insertion sheet exists using the feeding sensor 472. The movable plate 492 is one example of a member of which position changes according to the remaining amount of insertion sheets held in the insertion sheet feeding unit. The lift-up amount sensor 477 is one example of a position detection unit that detects the position of the member. The CPU 572 includes a computation section 1312 that computes the remaining amount of insertion sheets according to the position of the member.

The surface sensor 474 is one example of an insertion sheet detection unit that detects whether or not the insertion sheet stacked at the uppermost position among insertion sheets placed on the member exists at a position in which its feeding can be performed. The tray motor M75 is one example of a lift-up unit that lifts up the member until the insertion sheet detection unit detects that the insertion sheet stacked at the uppermost position is at located the position at which its feeding can be performed. In this case, the lift-up amount sensor 477 detects the lift-up amount of the member as the position of the member.

The media sensor 478 is one example of a type detection unit that detects the type of an insertion sheet. The CPU 201 or the CPU 572 may function as the determination section 1301 that determines the remaining amount threshold value which is in accordance with the type of the insertion sheet detected by the type detection unit. The input apparatus 300 of the operation unit 190 is one example of an input unit that inputs the type information related to the type of an insertion sheet. The CPU 201 may determine the remaining amount threshold value that is in accordance with the type information input from the input unit.

The type of an insertion sheet may be the grammage or the thickness per sheet of the insertion sheet. That is, by adjusting the remaining amount threshold value according to the grammage or the thickness per sheet of the insertion sheet, an appropriate feeding mode can be selected. The types of an insertion sheet may include thin paper, plain paper, and thick paper. By adjusting the remaining amount threshold value according to thin paper, plain paper, thick paper and the like, an appropriate feeding mode can be selected. As shown in FIGS. 11A and 11B, the CPU 201 may include a conversion section 1304 that converts the type of an insertion sheet to the remaining amount threshold value.

As shown in step S905, in the first mode, the CPU 201 includes a judgment section 1303 that judges that an insertion sheet exists in the insertion sheet feeding unit according to receiving the existence confirmation signal indicating that an insertion sheet exists in the insertion sheet feeding unit. If the existence confirmation signal has not been received, the CPU 201 may judge that an insertion sheet does not exist in the insertion sheet feeding unit. As shown in steps S905 and S907, after having judged that an insertion sheet exists in the insertion sheet feeding unit, the CPU 201 causes the sheet feeding unit to feed a sheet. As shown in steps S904 and S905, in the second mode, the CPU 201 may cause the sheet feeding unit to feed a sheet without causing the judgment section 1303 to judge that an insertion sheet exists in the insertion sheet feeding unit.

In the above-described embodiment, the remaining amount and the remaining amount threshold value are compared, but converting the position of the movable plate 492 to the remaining amount is not essential. For example, the CPU 201 or the CPU 572 may function as the determination section 1301 that determines a position threshold value that is in accordance with the type of an insertion sheet. The lift-up amount sensor 477 may function as a position detection unit that detects a position of the member. The CPU 201 may function as the selection section 1302 that, if the position of the member exceeds a position threshold value, selects the first mode as the feeding mode of the sheet feeding unit, whereas, if the position of the member does not exceed the position threshold value, selects the second mode as the feeding mode of the sheet feeding unit.

In the above-described embodiment, the remaining amount threshold value is corrected according to the type of an insertion sheet. Instead of this, the remaining amount threshold value may be fixed, and a measurement value of the remaining amount may be corrected. The lift-up amount sensor 477 functions as a detection unit that detects the remaining amount of insertion sheets held in the insertion sheet feeding unit. The CPU 201 and the CPU 572 function as a correction section 1313 that corrects the remaining amount of insertion sheets detected by the detection unit (measurement unit) according to the type of that insertion sheet. In this manner, because the measurement value of the remaining amount is corrected according to the type of an insertion sheet, a more accurate remaining amount can be obtained. In this case, the CPU 201 selects the first mode if the corrected remaining amount of insertion sheets does not exceed the remaining amount threshold value, and selects the second mode if the corrected remaining amount of the insertion sheets exceeds the remaining amount threshold value.

In this embodiment, the insertion sheet is fed from the insertion sheet tray 490 of the inserter 170. However, if the image forming device 100 has a plurality of feeding trays, the sheet S may be fed from one of the plurality of feeding trays, and an insertion sheet may be fed from another feeding tray. This corresponds to a case where the function of the inserter 170 is provided inside the image forming device 100.

A part or all of the sections realized by the CPU 201 and the CPU 572 executing the control program may be realized by a hardware circuit such as an ASIC or an FPGA. ASIC is an abbreviation for "Application Specific Integrated Circuit". FPGA is an abbreviation for "Field Programmable Gate Array".

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-109318, filed Jun. 1, 2017, which is hereby incorporated by reference herein in its entirety.

What is claimed is:

1. An image forming system comprising:

an image forming unit that forms an image on a sheet;

a sheet feeding unit that feeds the sheet from a sheet storage;

a first conveyance path through which the sheet is conveyed;

an insertion sheet stacking unit on which insertion sheets are stacked, one of the insertion sheets to be inserted prior to the sheet;

a second conveyance path through which the insertion sheet is conveyed from the insertion sheet stacking unit to a junction at which the second conveyance path is connected to the first conveyance path, wherein a length of the second conveyance path from the insertion sheet stacking unit to the junction is shorter than a length of the first conveyance path from the sheet storage to the junction;

a discharge unit that discharges the sheet and the insertion sheet conveyed through the first conveyance path;

a detection unit that detects a lift-up amount of the insertion sheet stacking unit;

an operation unit that is operated by an operator so as to input a grammage of the insertion sheets stacked on the insertion sheet stacking unit; and a processor that selectively executes a plurality of feeding modes, including a first mode and a second mode, based on the lift-up amount of the insertion sheet stacking unit detected by the detection unit and the grammage of the insertion sheet inputted to the operation unit, wherein the first mode is a mode in which the sheet feeding unit starts feeding the sheet based on presence/absence of the insertion sheet that is to be inserted prior to the sheet fed by the sheet feeding unit, and the second mode is a mode in which the sheet feeding unit starts feeding the sheet regardless of presence/absence of the insertion sheet that is to be inserted prior to the sheet fed by the sheet feeding unit, and the processor is further configured to:

obtain the lift-up amount of the insertion sheet stacking unit in a case in which an insertion sheet is fed from the insertion sheet stacking unit to the second conveyance path, select the first mode in a case in which the obtained lift-up amount is less than a threshold value, and select the second mode in a case in which the obtained lift-up amount is not less than the threshold value, and set the threshold value according to the grammage of the insertion sheet inputted from the operation unit.

2. The image forming system according to claim 1, further comprising:

an existence sensor that detects presence/absence of the insertion sheet on the insertion sheet stacking unit, and in the first mode, the processor confirms that the insertion sheet exists in the insertion sheet stacking unit using the existence sensor.

3. The image forming system according to claim 1, wherein the detection unit comprises:

a member provided for the detection unit, a position of the member changing according to the lift-up amount of the insertion sheet stacking unit; and a position sensor that detects a position of the member, wherein the processor computes the lift-up amount based on the position of the member.

4. The image forming system according to claim 3, further comprising:

an insertion sheet sensor that detects whether or not the insertion sheet stacked at an uppermost position among insertion sheets placed on the member is located at a position at which feeding can be performed; and a motor that lifts up the member until the insertion sheet sensor detects that the insertion sheet stacked at the uppermost position is located at the position at which feeding can be performed, wherein the position sensor detects a lift-up amount of the member as the position of the member.

5. The image forming system according to claim 1, wherein the processor, in the first mode, judges that the insertion sheet exists in the insertion sheet stacking unit according to reception of an existence confirmation signal indicating that the insertion sheet exists in the insertion sheet stacking unit, and judges that the insertion sheet does not exist in the insertion sheet stacking unit, in a case in which the existence confirmation signal has not been received, the processor causes the sheet feeding unit to feed the sheet after having judged that the insertion sheet exists in the insertion sheet stacking unit, and in the second mode, the processor causes the sheet feeding unit to feed the sheet without causing the judgement unit to judge the presence/absence of the insertion sheet in the insertion sheet stacking unit.

6. The image forming system according to claim 1, wherein the processor corrects the lift-up amount based on the grammage of the insertion sheets input by the operation unit.

* * * * *